United States Patent [19]

Lowthorp

[11] 4,127,758

[45] Nov. 28, 1978

[54] TACTILE LAYER HAVING HINGED DOME

[75] Inventor: Blaine G. Lowthorp, Northfield, Minn.

[73] Assignee: Sheldahl, Inc., Northfield, Minn.

[21] Appl. No.: 841,918

[22] Filed: Oct. 13, 1977

[51] Int. Cl.[2] ..... H01H 3/12; H01H 13/14

[52] U.S. Cl. ..... 200/340; 200/5 A; 200/159 B; 200/DIG. 1

[58] Field of Search ..... 200/5 R, 5 A, 159 R, 200/159 A, 159 B, 340, DIG. 1; 428/178–180

[56] References Cited

U.S. PATENT DOCUMENTS

| | | | |
|---|---|---|---|
| 1,958,050 | 5/1934 | Koppelman | 428/178 X |
| 3,503,031 | 3/1970 | Nyhus et al. | 200/DIG. 1 |
| 3,760,137 | 9/1973 | Shimojo et al. | 200/5 A X |
| 3,829,646 | 8/1974 | Lorteije et al. | 200/340 X |
| 3,860,771 | 1/1975 | Lynn et al. | 200/340 X |
| 3,898,421 | 8/1975 | Suzumura | 200/159 B |
| 3,971,902 | 7/1976 | Wulf et al. | 200/5 A |
| 4,034,176 | 7/1977 | Larson | 200/159 B |

FOREIGN PATENT DOCUMENTS

| | | |
|---|---|---|
| 1,817,569 | 8/1969 | Fed. Rep. of Germany. |
| 2,284,177 | 4/1976 | France. |
| 24,881 | 12/1905 | Sweden. |
| 545,991 | 2/1974 | Switzerland. |

*Primary Examiner*—Stephen Marcus

*Attorney, Agent, or Firm*—Orrin M. Haugen; Thomas J. Nikolai

[57] ABSTRACT

A tactile layer for use in combination with diaphragm-type switch keyboards to impact a tactile signal to the user upon depression of a key. The tactile layer comprises a sheet of Mylar polyester material having integrally formed deformations therein wherein the deformation is in the form of an annular ring hingedly supporting a dome shaped projection about a generally circular transition line, the transition line being displaced a first predetermined distance from the plane of the sheet which is less than the distance which the top of the dome shaped projection is displaced from the plane of the sheet.

5 Claims, 3 Drawing Figures

TACTILE LAYER HAVING HINGED DOME

BACKGROUND OF THE INVENTION

I. Field of the Invention

This invention relates generally to an article of manufacture and more specifically to a tactile layer which may be embodied in a diaphragm-type switch keyboard to impart a tactile signal to the user that a switch closure has been made. Keyboards of the type described find wide application in a variety of devices including hand calculators, remote TV tuners, computer I/O devices, etc.

II. Discussion of the Prior Art

Diaphragm-type switches are well known in the art. They generally comprise first and second spaced apart contacts, one of the contacts being disposed on a flexible membrane. When force is applied to the membrane it deforms, sometimes through an apertured spacer layer, to establish an electrical contact. Typical of this arrangement is that shown in the Krakinowski U.S. Pat. No. 3,308,253 and the Kaelin et al. U.S. Pat. No. 3,732,389. The foregoing arrangements are exemplary of so-called non-tactile keyboards wherein depression of the membrane does not provide a noticeable impulse to the finger of the user upon switch actuation.

Tactile-type diaphragm switches are also known in the art. For example, reference is made to the published German patent application No. 1,806,241, published Aug. 14, 1969 which teaches the use of a metallic dome shaped projection which when depressed, provides a noticeable snap as the dome is inverted to establish the electrical contact. When the finger pressure is removed, the dome is restored to its normal, non-inverted configuration. This arrangement is commonly referred to as incorporating the "oil-can" effect. Another example of this arrangement is set forth in the IBM Technical Disclosure Bulletin, Volume 7, No. 12, dated May 1965, only here, rather than a metallic dome, a plastic membrane having a dimpled surface is employed.

The Lynn et al. U.S. Pat. No. 3,860,771 and the Adams et al. U.S. Pat. No. 3,246,112 each discloses a tactile keyboard arrangement in which the tactile layer comprises a sheet of flexible plastic material having integrally formed depressions comprising a generally cylindrical pedestal having straight or sloping walls and topped or capped by a portion of a curved surface, such as a portion of a sphere. Again, as the dome is inverted, the user is provided with a snap action indicative of a contact closure.

The tactile layer of the present invention is deemed to be an improvement over the aforementioned prior art arrangements in that it provides a keyboard arrangement that is not subject to "edge toggling". As is set forth in my co-pending patent application Ser. No. 841,981, filed Oct. 13, 1977 and entitled "TACTILE TOUCH SWITCH PANEL", devices made in accordance with certain aspects of the prior art suffer from a defect which may be termed "edge toggle". Edge toggle occurs when only one portion of the tactile dome collapses, or when one portion of the dome collapses late and produces a double tactile feedback sensation. This edge toggle always occurs along a crease line where the slope of the crease's center wall approaches the vertical. Five characteristics of edge toggling may be observed and are as follows:

1. The action is not concentric and proceeds from the center of the dome to only one segment of the outer circumference thereof;
2. The collapse of the dome is not catastrophic and does not always go to completion;
3. Movement of the flexible dome material is not always isolated within the dome and tends to lift the surrounding circuit layer from its substrate;
4. The tactile feedback sensation is very dependent upon the location on the dome where the force is applied; and
5. The tactile feedback is not consistent and may be different every time the dome is collapsed.

In addition to the undesirable edge toggling effect, it has also been found that certain keyboards having simple domes in their tactile layer tend to show a substantial variation in "feel" depending upon the location of the key on the keyboard. More specifically, when the keys are arranged in rows and columns and where simple domes are employed such as in the aforereferenced IBM Technical Disclosure Bulletin, one can easily detect a variation in feel between the keys located at the corners of the array than that which is obtained from keys which are surrounded on all four sides by other key locations. In the same fashion, still a different "feel" is observed at key locations along the edges of the array, but which are not corner locations. This variation in "feel" is, of course, objectionable.

In accordance with the teachings of the Lynn et al Patent referred earlier, in order to obtain a desired feel, the use of an apertured spacer disposed between the tactile layer and the circuit bearing layer is recommended. This additional spacer layer naturally increases the complexity and attendant cost of a keyboard.

SUMMARY OF THE INVENTION

In accordance with the teachings of the present invention, I provide a tactile layer for use in a diaphragm-type switch configuration which obviates the foregoing problems with the prior art. Specifically, the design of the dome shaped depression in the tactile layer is such that "edge toggling" cannot occur. Furthermore, when utilizing the tactile layer of the present invention in a diaphragm-type keyboard, the need for an apertured spacer between the tactile layer and the circuit bearing layer is rendered unnecessary. Also, because of the particular configuration employed for supporting the dome shaped projections in the tactile layer, a consistent and uniform "feel" is imparted to the finger of the user, irrespective of the location in a switch array. That is, corner, edge and surrounded switch locations all produce a substantially identical feel.

The foregoing advantages are obtained by providing a tactile layer which comprises a sheet of Mylar polyester material or a Mylar equivalent having first and second generally planar surfaces and having one or more integrally formed deformations extending inwardly from the surface of the sheet and outwardly from a second surface of the sheet. The deformations have a unique shape. Specifically, the deformations comprise a generally parabolic disc having a raised center portion and an annular ring projecting upwardly and outwardly from the edge of the parabolic disc. The annular ring joins the parabolic disc along a generally circular transition line. The transition line is normally (in its undepressed state) located at the apex of an acute angle formed between tangents to the parabolic disc and to the annular ring at their line of intersection. Also, in accordance with the instant invention, the raised center portion of the parabolic disc is displaced further from the planar surfaces of the Mylar sheet than is the generally circular transition line. As a result, the annular ring acts as a hinge for accommodating inversion of the parabolic disc when a force is applied against the outer surface of the raised center portion of the parabolic disc. Because of the hinge arrangement, edge toggling is precluded and adjacent parabolic discs on the keyboard are isolated one from the other such that uniformity is obtained in the feel imparted to the finger of the user. The tactile layer of the present invention may be employed in a diaphragm-type switch without the need for an intermediate spacer layer having apertures through which the dome is inverted. Furthermore, by a proper choice of dimensions for the degree of depression of the annular ring with respect to the generally parabolic disc which it surrounds, it is possible to provide a controlled variation in the degree of tactile feedback such that keyboards made for different applications may have differing "feels".

These and other characteristics and advantages of the present invention will become apparent from the following detailed description of the preferred embodiment when considered in conjunction with the accompanying drawings in which:

DESCRIPTION OF THE PREFERRED EMBODIMENT

Figure 1:
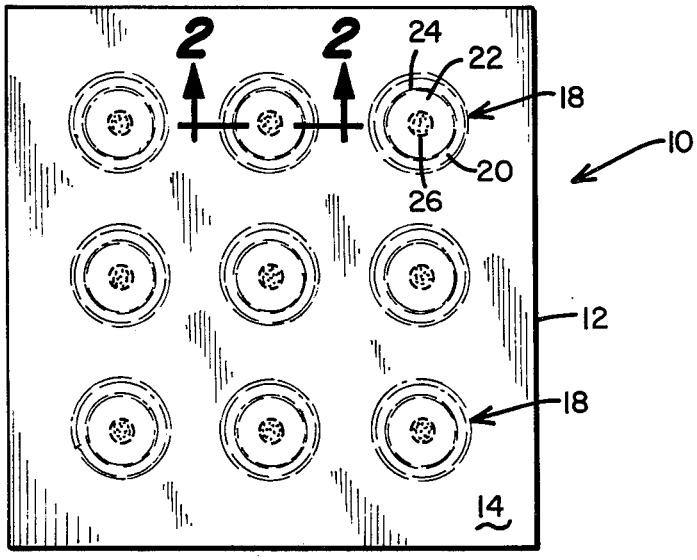
FIG. 1 is a top view of the tactile layer made in accordance with the present invention.
Figure 2:
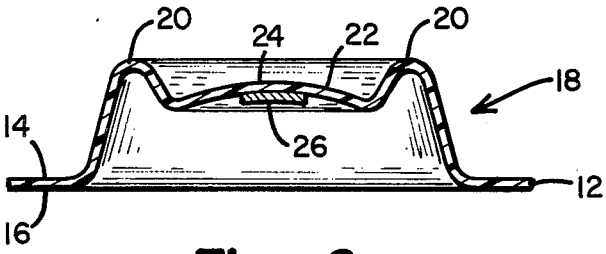
FIG. 2 is a greatly enlarged cross-section taken along the line 2—2 in FIG. 1.

Referring now to FIG. 1, there is shown a top view of the tactile layer comprising the preferred embodiment of the present invention. It is indicated generally by numeral 10 and comprises a generally planar sheet 12 of a suitable plastic material such as a Mylar polyester material of substantially constant thickness having a top surface 14 and a bottom surface 16 (FIG. 2). The material 12 is preferably prestabilized in a controlled heating step to eliminate thermal shrink, this being done in a conventional and well known process. The prestabilized Mylar sheet 12 is then deformed at predetermined locations by means of a suitably shaped die to form a plurality of dome shaped projections 18—18 which in the plan view of FIG. 1 include an annular ring 20 surrounding a parabolic disc or dome 22. The transition line 24 between the annular ring 20 and the domed disc 22 is generally circular in its plan view. With reference to FIG. 2, disposed on the underside of the circular dome 22 is an electrically conductive spot 26 which is shown in FIG. 1 as a circular dot which shows through the translucent sheet 12.

The shape of the dome shaped projection 18 can best be seen in the enlarged cross-sectional view of FIG. 2. The sheet 12 is deformed inwardly from the surface 16 and outwardly from the surface 14 and the deformation comprises a generally parabolic disc 22 having a raised center portion 24 and an annular ring 20 projecting upwardly and outwardly from the edge of the parabolic disc 22. The annular ring 20 joins the parabolic disc along a generally circular transition line 24. As can be seen from FIG. 2, when the dome 22 is in its non-inverted state as illustrated the transition line 24 is generally located at the apex of an acute angle defined by tangents drawn to the surface of the parabolic disc 22 and to the annular ring at their line of intersection. It is also to be noted that the raised center portion 24 of the parabolic disc 22 is displaced a greater distance from the planar surface of sheet 12 than is the generally circular transition line 24.

When a downward force is applied to the parabolic disc portion 22 of the dome shaped projection 18 the annular ring 20 acts as a hinge for facilitating the inversion of the parabolic disc portion 22.

Figure 3:
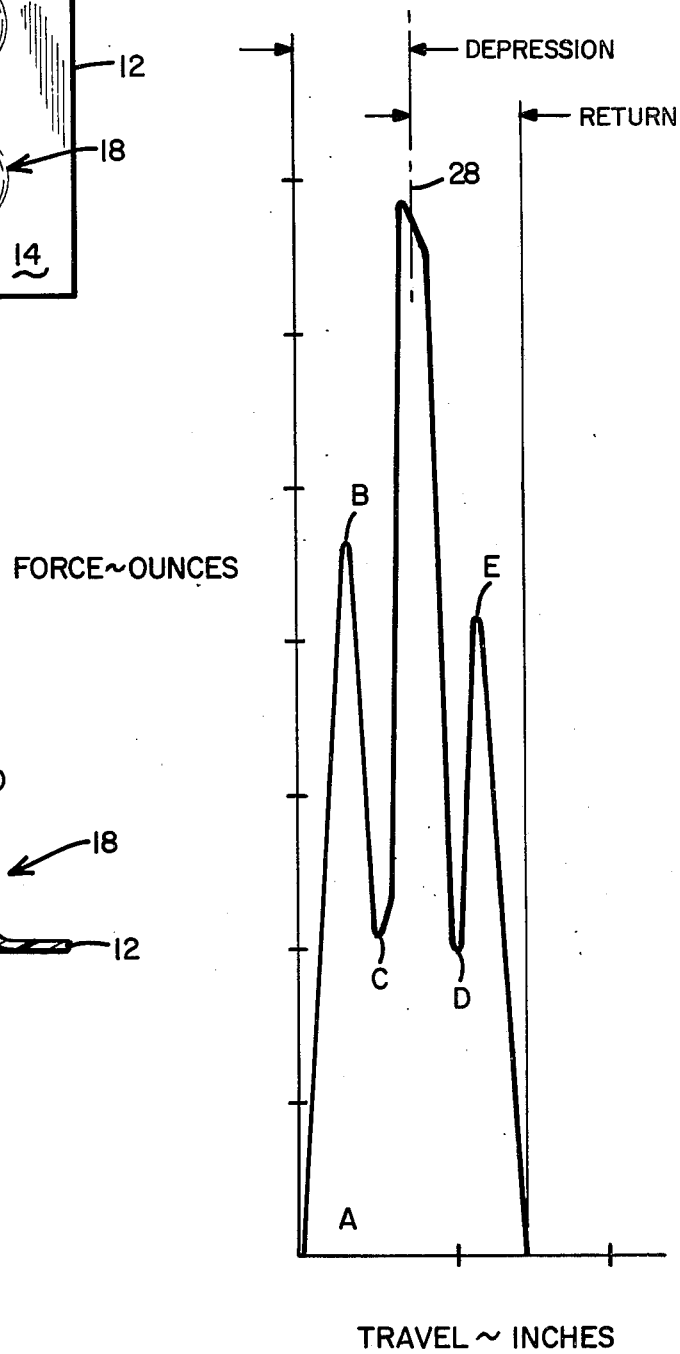
FIG. 3 is a typical force-key travel curve for a diaphragm-type switch incorporating the tactile layer of the present invention.

FIG. 3 is a typical force-travel diagram of the dimple 18 when formed as set forth above. Plotted along the ordinate axis in ounces is the applied and return force tending to invert and restore the disc 22, respectively, and along the abscissa is plotted the travel of the central portion 24 of the disc 22 when a force is applied and subsequently removed. The point labeled A represents the zero force condition and, of course, there is no deformation or travel associated with it. As the force increases a peak B is reached where the dome 18 inverts resulting in a marked decrease in the applied force to a valley point C. This is followed by a sharply increasing rise indicating an inappreciable travel associated with a large applied force. At the valley point C, the dome has bottomed out so that the increase force does not produce a significant travel. As the force is removed, as at point 28, a point D is reached where the "oil-can" effect takes over to produce an upward force against the switch actuating key, the maximum return force being indicated by the peak E.

The Tactile Ratio may be defined as (B−C)/B. It has been found that a Tactile Ratio in the range of 30 to 40% is ideal from the standpoint of operator satisfaction. Experiments conducted on the preferred embodiment have shown that it is possible to approach this ideal value. Similarly, it is possible to define a Return Force Ratio as being equal to E/B. An ideal Return Ratio is, of course, 100%. Again, experimental tests conducted indicate that a return ratio of 90% is readily obtainable with a tactile layer of the type described herein. These values, when compared to corresponding values obtained through testing of tactile layers having simple spherical domes formed therein, reveals that the present invention offers a substantial improvement.

Of course, various parameters affect the tactile response obtained from the tactile layer formed in accordance with the teachings of the present invention. Variations in the thickness and tensile strength of the sheet material 12 affects the tactile feedback. It has been found that a Mylar polyester sheet 12 having a thickness of approximately 5 mils is most suitable. The diameter of the parabolic disc 22 and key travel are dependent upon the spherical dome radius. As the diameter, radius and key travel becomes smaller, the tactile feedback becomes more pronounced. Disc diameter appears to have a significant effect and it has been found that diameters in the range of 0.250 to 0.300 inches give excellent results. The dome's radius of curvature affects the tactile feedback by regulating both the amount of Mylar stretch and the key travel. Good results have been obtained using a spherical radii in the range of 0.25 to 0.50 inches. Non-spherical discs surrounded by the annular ring can be used to obtain shorter key travel while still providing sufficient stretch to produce a good tactile signal.

While there have been described above the principals of this invention in connection with a specific arrangement, it is to be clearly understood that this description is made only by way of example and not as a limitation to the scope of the invention.

What is claimed is:

1. An article of manufacture comprising:

(a) a sheet of flexible material of substantially constant thickness having first and second surfaces and having at least one integrally formed deformation extending inwardly from said first surface and outwardly from said second surface thereof, said deformation being in the form of an annular ring portion completely surrounding a circular convex dome shaped projection and extending upwardly and outwardly therefrom.

2. The article as in claim 1 wherein said material is prestabilized polyester plastic and wherein the thickness of said sheet is about 5 mils.

3. The article as in claim 1 and further including an electrically conductive material disposed on said first surface in the area of the center of said dome shaped projection.

4. The article as in claim 1 wherein the intersection of said annular ring portion and said circular dome shaped projection is displaced a predetermined distance from the plane of said sheet surrounding said deformation.

5. The article as in claim 4 wherein the furthest displacement of said annular ring portion from the plane of said sheet surrounding said deformation is greater than said predetermined distance.

* * * * *